US005182835A

United States Patent [19]

de' Giudici

[11] Patent Number: 5,182,835

[45] Date of Patent: Feb. 2, 1993

[54] METHOD AND PLANT FOR MAKING LAPS FOR FELTS

[75] Inventor: Angelo de' Giudici, Mestre-Venezia, Italy

[73] Assignee: Feltrifico Vaneto S.p.A., Mestre-Venezia, Italy

[21] Appl. No.: 675,159

[22] Filed: Mar. 26, 1991

[30] Foreign Application Priority Data

Jul. 18, 1990 [IT] Italy ..... 12488 A/90

[51] Int. Cl.[5] ..... D01G 25/00

[52] U.S. Cl. ..... 19/296; 19/163

[58] Field of Search ..... 19/296, 161.1, 163; 28/101, 102; 66/84 A

[56] References Cited

U.S. PATENT DOCUMENTS

| | | | |
|---|---|---|---|
| 2,927,350 | 3/1960 | Nelson | 19/163 |
| 3,660,867 | 5/1972 | Watson | 19/163 |
| 3,689,349 | 9/1972 | Burger | 28/101 |
| 3,747,162 | 7/1973 | Watson | 19/163 |
| 3,879,820 | 4/1975 | Grieves et al. | 19/163 |
| 3,903,568 | 9/1975 | Watson | 19/163 |
| 4,481,694 | 11/1984 | Dilo | 19/163 |

FOREIGN PATENT DOCUMENTS

| | | | |
|---|---|---|---|
| 1371984 | 3/1964 | France | 19/161.1 |

*Primary Examiner*—Peter Nerbun
*Assistant Examiner*—Michael A. Neas
*Attorney, Agent, or Firm*—Larson and Taylor

[57] ABSTRACT

A method and a plant for making laps (FA) starting from card webs (V), particularly for making laps for felts, such as felts for paper machines, or the like. By using most of the existing machinery, the laps (FA) of any desired width dimension however greater than that of card webs (V) are simply made, with the lap fibers being substantially arranged in the longitudinal direction (D) of laps (FA). According to the invention, an intermediate ribbon lap (N) is formed from a card web (V) delivered from card (C), by causing the card web (V) to be folded in the card web longitudinal direction (A) by a first lap-laying apparatus (F1), and laid at the same time on an associated first conveyor (T1), the fibers in the intermediate ribbon lap (N) being arranged substantially in the transverse direction of the intermediate ribbon lap (N). Then, from the intermediate ribbon lap (N), a lap (FA) is made by causing the intermediate ribbon lap (N) to be folded in its longitudinal direction (B) by a second lap-laying apparatus (F2), and laid on an associated second conveyor (T2), the fibers in lap (FA) being arranged substantially in the longitudinal direction (D) of lap (FA).

22 Claims, 2 Drawing Sheets

METHOD AND PLANT FOR MAKING LAPS FOR FELTS

SUMMARY OF THE INVENTION

A method for making laps for felts, particularly for making laps for needled felts for paper machines, or the like. According to the method of the invention, a card web delivered from a card is so folded that a lap is finally made, and is used for manufacturing felt.

This invention aims to make laps for the manufacturing of felts, particularly for the manufacturing of felts for paper machines, or the like, with the lap fibers being arranged substantially in the longitudinal direction of the laps, which is the direction in which a felt in the course of being manufactured from a lap, is moved in a felt machine, and/or in a felt-using machine.

The fibers in a card web delivered from a card, are arranged in the card web longitudinal direction. Therefore, a card web may be used for directly feeding a needle felt machine in-line with a card, whereby a needled felt would be manufactured, with the felt fibers being arranged in the longitudinal direction of the felt. However, a card web delivered from a card has a width dimension that is much narrower than that of a felt to be desirably manufactured, so that such a procedure is not usable for the manufacturing of felts with the presently required greater width dimensions.

In the prior art, a method was proposed for manufacturing felts of a width dimension being greater than that of card webs delivered from a card, and with the felt fibers being arranged in the longitudinal direction of the felts. According to this known method, a card is imparted a transversally reciprocating motion, and is caused to feed each card web in a helical fashion to a successive needle felt machine.

According to another prior art method that was proposed for manufacturing felts of a width dimension being greater than that of card webs delivered from a card, and with the felt fibers being arranged in the longitudinal direction of the felts, a card web is cut into longitudinal strips which are laid in a superposed relation, and are helically wound about a tensioning device imparted with a reciprocating motion transversally to the card. The superposed, helically wound card web layers are firmly joined together by a special pre-needling machine, and the annular element thus obtained therefrom, is then fixed to an undercloth by a normal needle felt machine.

According to a still another known method, a card web is formed into a roll and is then fed in a helical fashion to a needle felt machine, through a small pre-needling machine mounted on the table from which the pre-needled felt is fed to the needle felt machine.

For carrying out these known methods, special machinery is required for all of them, and relative transverse motions need to be imparted either to the card and the needle felt machine, or to the card and the card web-winding device, or to the card web and the needle felt machine, so that respective functional and constructional complications are originated, which result in a higher expenditure.

The invention aims to eliminate the aforementioned drawbacks by the provision of a simple and economical method as stated at the outset, for manufacturing felts of any desired width dimension however greater than that of card webs, and with the felt fibers being arranged in the longitudinal direction of the felts. According to the felt-manufacturing method of the invention, an intermediate ribbon lap is at first formed from a card web delivered from a card, by a causing the card web to be folded in the card web longitudinal direction, and from the intermediate ribbon lap, a lap is nextly made, by causing the intermediate ribbon lap to be folded in the ribbon lap longitudinal direction.

Therefore, by the method according to the invention, a lap for manufacturing a felt is made by causing a card web delivered from a card to be folded a first time, and then to be folded a second time, at 90° relative to the first folding thereof. Thus, the card web is at first folded in the card web longitudinal direction, so that from the card web an intermediate ribbon lap is formed, with the ribbon lap fibers being arranged substantially in the transverse direction of the intermediate ribbon lap. From the intermediate ribbon lap being nextly folded in the ribbon lap longitudinal direction, a lap is made with the lap fibers being arranged substantially in the longitudinal direction of the lap.

According to the invention, the intermediate ribbon lap is preferably formed from a card web delivered from a card, by causing the card web to be folded in the card web longitudinal direction by a first lap-laying apparatus, and laid at the same time on a first conveyor which is the ribbon lap-carrying conveyor, the said first conveyor extending and being caused to run transversally to the longitudinal direction in which the card web is being delivered from the card.

A card web delivered from a card may be continuously folded, and the ribbon lap-carrying conveyor may be caused to continuously run forward, so that from the card web being laid on the said first ribbon lap-carrying conveyor in a zig-zag or helical fashion, a continuous intermediate ribbon lap is formed, with the ribbon lap fibers being thus transversally arranged in a slightly inclined relation, and alternately in the one and the opposite direction, relative to the ribbon lap transverse direction that is orthogonal to the longitudinal direction of the intermediate ribbon lap.

However, a card web delivered from a card may be also intermittently folded, and the ribbon lap-carrying conveyor may be also caused to intermittently run forward, and such an intermittent folding of the card web and forward running of the ribbon lap-carrying conveyor may be combined with an intermittent cutting of the card web. Thus, on the ribbon lap-carrying conveyor a discontinuous intermediate ribbon lap is formed from at least one layer of a card web cut into lengths, and consists of longitudinal, endwise arranged, and may be at least partly overlapped, successive ribbon lap lengths, with the fibers in the ribbon lap lengths being arranged in the ribbon lap length transverse direction that is orthogonal to the longitudinal direction of the discontinuous ribbon lap N.

According to one preferred embodiment of the invention, a lap is similarly formed from an intermediate ribbon lap—which in turn has been formed from a continuously or intermittently folded card web, by causing the intermediate ribbon lap to be folded card web, by causing the intermediate ribbon lap to be folded in the ribbon lap longitudinal direction, and laid on a second conveyor which is the lap-carrying conveyor, the said second conveyor extending and being caused to run transversally to the longitudinal direction of the intermediate ribbon lap.

Thus, also the intermediate ribbon lap may be continuously folded, and the lap-carrying conveyor may be caused to continuously run forward, so that on the second lap-carrying conveyor a continuous lap is formed from the intermediate ribbon lap having been continuously laid in a zig-zag or helical fashion on the second lap-carrying conveyor, with the lap fibers being thus arranged in the longitudinal direction of the continuous lap, in a slightly inclined relation, and alternately in the one and the opposite direction.

However, also the intermediate ribbon lap may be intermittently folded, and the lap-carrying conveyor may be caused to intermittently run forward, and such an intermittent folding of the intermediate ribbon lap and forward running of the lap-carrying conveyor may be combined with an intermittent cutting of the intermediate ribbon lap. Thus, on the second lap-carrying conveyor a discontinuous lap is formed from at least one layer of the intermediate ribbon lap cut into lengths, and consists of longitudinal, endwise arranged, and may be at least partly overlapped, successive lap lengths, with the fibers int the lap lengths being arranged in a slightly inclined relation in the longitudinal direction of the discontinuous lap and alternately in the one and the opposite direction.

The method for making laps for felts, according to the invention, may be carried out by means of any suitable plant fitted with any suitable devices and machines.

However, the invention contemplates also a particular plant for carrying out the method according to the invention, and specifically for putting into effect the aforementioned preferred embodiments of this method.

The plant of the invention comprises a card, and a first, either continuously or intermittently operated lap-laying apparatus arranged over a first conveyor which is the ribbon lap-carrying conveyor, and extends and is caused to run transversally to the longitudinal direction in which a card web is being delivered from a card. The said first lap-laying apparatus causes the card web to be folded in the card web longitudinal direction, and laid at the same time on the said first ribbon lap-carrying conveyor, so that from the card web a continuous or discontinuous intermediate ribbon lap is formed on the ribbon lap-carrying conveyor, with the ribbon lap fibers being arranged substantially in the transverse direction of the intermediate ribbon lap.

The plant of the invention comprises also a second, either continuously or intermittently operated lap-laying apparatus arranged over a second conveyor which is the lap-carrying conveyor, and extends and is caused to run transversally to the first ribbon lap-carrying conveyor. The second lap-laying apparatus causes the intermediate ribbon lap to be folded in the ribbon lap longitudinal direction, and laid on the second lap-carrying conveyor, so that from the intermediate ribbon lap, a continuous or discontinuous lap is formed on the lap-carrying conveyor, with the lap fibers being arranged substantially in the longitudinal direction of the lap.

The thus made lap is used for the manufacturing of felt and is, for example, fed to a successive needle felt machine.

Also in this plant, the card, the two lap-laying apparatus, the associated conveyors, and the may-be successive needle felt machine may be made in any suitable manner.

These and other features of the invention, and the advantages arising therefrom will clearly appear in the following description of one preferred embodiment of the same, which is shown by way of a non-limiting example in the accompanying drawings.

DESCRIPTION OF THE PREFERRED EMBODIMENT

Figure 1:
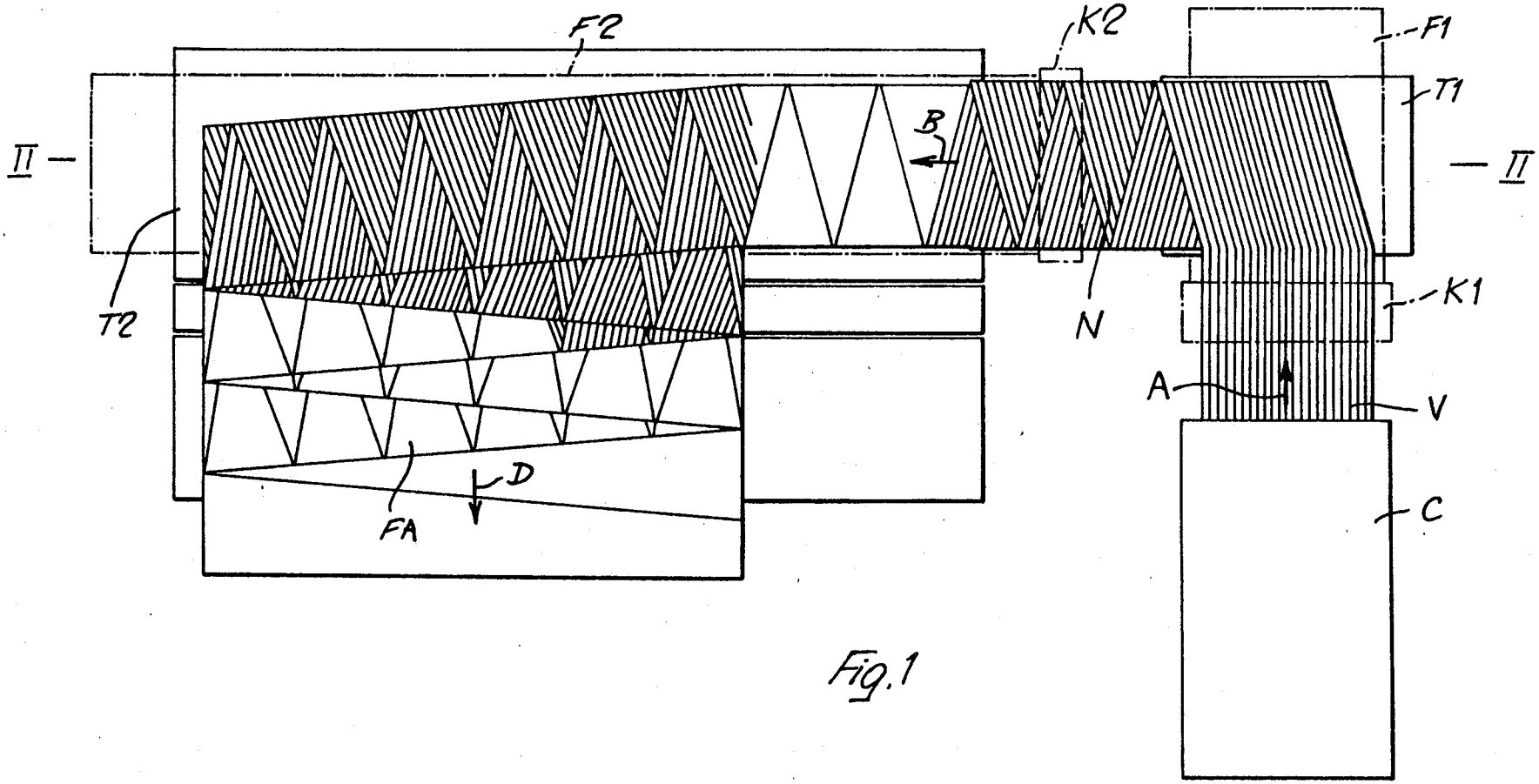
FIG. 1 is a plan view diagrammatically showing a plant for carrying out the method according to the invention.
Figure 2:
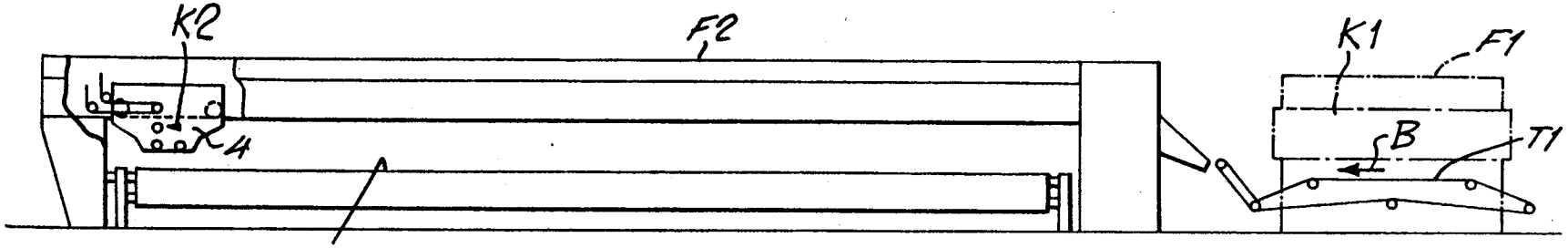
FIG. 2 is a diagrammatic, vertical sectional view taken on line II—II in FIG. 1, of the plant shown in FIG. 1.

Referring to the drawings, there is shown that a card web V is delivered from a card C, with the card web fibers being arranged in the longitudinal direction of card web V, i.e., in the direction A in which the card web V is being drawn forward. The card web V is folded by a first lap-laying apparatus F1 in the longitudinal direction A of card web V, and is laid on an underlying first conveyor T1 which is the ribbon lap-carrying conveyor, the said first conveyor T1 extending and being caused to run in the direction of arrow B, transversally to the longitudinal direction A in which the card web V is being delivered from card C.

In the shown embodiment, the first lap-laying apparatus F1 is continuously operated, and also the first ribbon lap-carrying conveyor T1 is caused to continuously run, so that from a card web V being continuously folded in its longitudinal direction A, by the first lap-laying apparatus F1, and being at the same time laid in a zig-zag or helical fashion on the first ribbon lap-carrying conveyor T1, a continuous intermediate ribbon lap N is formed on the said first conveyor T1, as diagrammatically shown in FIG. 1.

Then, the intermediate ribbon lap N is continuously fed from the first ribbon lap-carrying conveyor T1 to a successive, second lap-laying apparatus F2, by which the intermediate ribbon lap N is folded in its longitudinal direction B, and is laid in a zig-zag or helical fashion, on an underlying second conveyor T2 which is the lap-carrying conveyor, the said second conveyor T2 extending and being caused to run in the direction of arrow D, transversally to the longitudinal direction B in which the intermediate ribbon lap N is fed into the second lap-laying apparatus F2.

In the same embodiment, also the second lap-laying apparatus F2 is continuously operated, and also the associated lap-carrying conveyor T2 is caused to continuously run, so that on the second lap-carrying conveyor T2 a continuous lap FA is formed from the intermediate ribbon lap N being folded in its longitudinal direction B by the second lap-laying apparatus F2, and being laid in a zig-zag or helical fashion on the second lap-carrying conveyor T2. The thus made lap FA is used for manufacturing felt and is, for example, fed to a needle felt machine (not shown).

The lap-laying apparatus F1 and F2 may be both made in any suitable manner.

Figure 3:
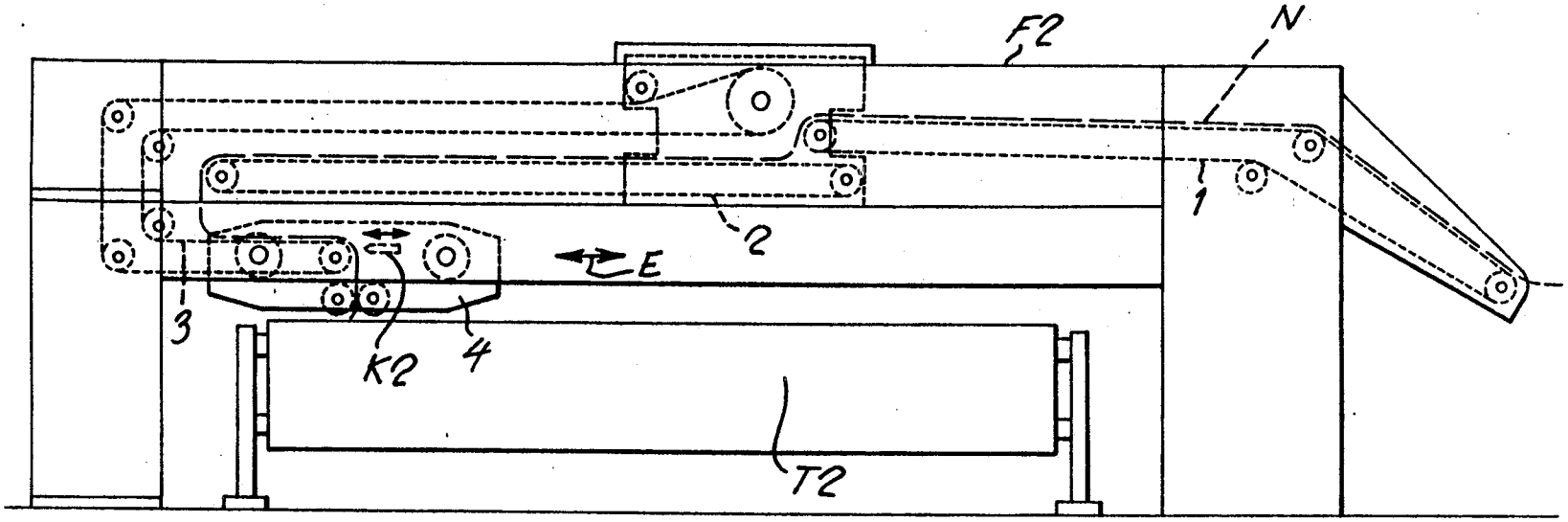
FIG. 3 is a view in an enlarged scale, diagrammatically showing some components of the second lap-laying apparatus in the plant according to FIGS. 1 and 2.

Diagrammatically shown in FIG. 3 are some components of the second lap-laying apparatus F2, i.e., the feeding conveyor 1 that feeds the intermediate ribbon lap N into the said apparatus F2, the conveyor 2 that receives the intermediate ribbon lap N from the ribbon lap-feeding conveyor 1, the conveyor 3 on to which the intermediate ribbon lap N is transferred and laid by the said conveyor 2, and the ribbon lap distributor carriage 4 that is associated with the said conveyor 3, and is imparted a reciprocating motion in the direction of arrow E, transversally to the lap-carrying conveyor T2. Such a lap-laying apparatus is known to those skilled in the art, so that a detailed description of the same need not to be made.

Also the first lap-laying apparatus F1 may be made similarly to the second lap-laying apparatus F2, so that the operative components of the lap-laying apparatus F1 are not shown.

From the foregoing, it is clearly apparent that the fibers in a lap FA will be arranged substantially in the longitudinal direction of lap FA, and that the width dimension of a thus made lap FA will be greater than that of a card web V delivered from a card C. Practically, a lap FA may have any desired width dimension however greater than that of card web V, which depends only from the operative range of the second lap-laying apparatus F2, for example, from the length of travel of its distributor carriage 4.

Such a longitudinal arrangement of the fibers in lap FA may be achieved when both the lap-laying apparatus F1 and F2 are continuously operated, and both the ribbon lap-carrying conveyor T1 and lap-carrying conveyor T2 are caused to continuously run, according to the shown embodiment.

Actually, from a card web V being continuously folded by the continuously operated lap-laying apparatus F1 in the card web longitudinal direction A, and being at the same time laid in a zig-zag or helical fashion on a ribbon lap-carrying conveyor T1 which is caused to continuously run transversally to the card web longitudinal direction A, a continuous intermediate ribbon lap N is formed on conveyor T1, with the ribbon lap fibers being substantially arranged transversally of the intermediate ribbon lap N, in a slightly inclined relation, and alternately in the one and the opposite direction that is orthogonal to the longitudinal direction B of the intermediate ribbon lap N. Then, from the intermediate ribbon lap N being continuously folded in its longitudinal direction B by the continuously operated lap-laying apparatus F2, and being laid in a zig-zag or helical fashion on a lap-carrying conveyor T2 which is caused to continuously run transversally to the longitudinal direction B of the intermediate ribbon lap N, a continuous lap FA is made on conveyor T2. Therefore, the fibers of the thus made lap FA will be just arranged longitudinally of lap FA, in a slightly inclined relation, and alternately in the one and the opposite direction, relative to the longitudinal direction of the continuous lap FA.

As mentioned in the Summary of the Invention, the first lap-laying apparatus F1 may be also intermittently operated, and also the first ribbon lap-carrying conveyor T1 which is associated with the said apparatus F1, may be caused to intermittently run forward. The lap-laying apparatus F1 is also associated with a device K1 for cutting a card web V delivered from card C, so that card web lengths are cut from card web V and are at the same time laid one after the other on the first ribbon lap-carrying conveyor T1, in a single or plural layer, and may-be at least in a partly overlapped relation. Thus, on the ribbon lap-carrying conveyor T1 a discontinuous intermediate ribbon lap N consisting of ribbon lap lengths is formed, with the fibers in the ribbon lap lengths being arranged orthogonally to the longitudinal direction of the discontinuous ribbon lap N, i.e., orthogonally to the direction B in which the ribbon lap-carrying conveyor T1 is caused to run.

Also the second lap-laying apparatus F2 may be intermittently operated, and also the second lap-carrying conveyor T2 which is associated with the lap-laying apparatus F2, may be caused to intermittently run forward. Also in this case, the lap-laying apparatus F2 is associated with a device K2 for cutting the intermediate ribbon lap N being fed into the said apparatus F2. Thus, from the intermediate ribbon lap N ribbon lap lengths are cut and laid one after the other on the lap-carrying conveyor T2, in a single or plural layer, and may be at least in a partly overlapped relation.

Such a cutting of the intermediate ribbon lap N into ribbon lap lengths to be sequentially laid on the lap-carrying conveyor T2, may be effected both when the intermediate ribbon lap N is formed from a card web V being continuously folded in a zig-zag or helical fashion by a first, continuously operated lap-laying apparatus F1, according to the shown embodiment, and when the intermediate ribbon lap N is formed, as disclosed above, by a first, intermittently operated lap-laying apparatus F1 from one or more than one layer of a card web V cut into lengths, so that the intermediate ribbon lap N consists of at least one, or more than one layer of endwise arranged ribbon lap lengths.

The longitudinal arrangement of the lap fibers may be achieved also when the first and the second lap-laying apparatus F1, F2, provided each with the device K1, K2 for respectively cutting the card web V and the ribbon lap N, are both intermittently operated, and the associated ribbon lap-carrying and lap-carrying conveyors T1 and T2 are both caused to intermittently run, so that the fibers in a discontinuous lap FA made from an intermediate ribbon lap N consisting of ribbon lap lengths, will be just arranged in the longitudinal direction D of lap FA.

Apart from the above-disclosed advantages, the invention also affords further advantages, which reside in the low cost of the plant according to the invention; in the existing machinery being usable, without the needing techniques having to be modified; and in a very reduced floor space being occupied by the additional lap-laying apparatus F1, in that the overall dimensions of this lap-laying apparatus are relatively small.

I claim:

1. A method for making final laps for needled felts comprising the steps of:

delivering a card web from a card with lap fibers substantially parallel to a delivery direction;

intermediately folding the card web intermittently in the delivery direction onto an intermediate ribbon lap-carrying conveyor which extends and is caused to intermittently run transversely to the delivery direction such that an intermediate ribbon lap is provided on the conveyor having a longitudinal extent and the lap fibers substantially arranged parallel to the delivery direction;

cutting of the card web into ribbon lengths so that on the intermediate ribbon lap-carrying conveyor the intermediate ribbon lap is discontinuous and formed successively from at least one layer of the ribbon lengths arranged longitudinally and endwise; and finally folding the intermediate ribbon lap in the direction of the longitudinal extent to form a final lap having a width dimension greater than that of the card web and the lap fibers substantially arranged in a longitudinal direction of the final lap.

2. A method for making final laps as claimed in claim 1 wherein said intermediate folding step includes the step of overlapping the ribbon lengths.

3. A method for making final laps as claimed in claim 1 wherein said final folding step folds the intermediate ribbon lap onto a final lap-carrying conveyor which extends and is caused to run transversely to the longitudinal extent of the intermediate ribbon lap.

4. A method for making final laps as claimed in claim 3 wherein said final folding step intermittently folds the intermediate ribbon lap onto the final lap-carrying conveyor which is intermittently run; and further including the step of cutting of the intermediate ribbon lap into final lap lengths so that on the final lap-carrying conveyor the final lap is discontinuous and formed successively from at least one layer of the final lap lengths arranged longitudinally and endwise.

5. A method for making final laps as claimed in claim 4 wherein said final folding step includes the step of overlapping the final lap lengths.

6. A method for making final laps for needled felts comprising the steps of:

delivering a card web from a card with lap fibers substantially parallel to a delivery direction;

intermediately folding the card web in the delivery direction such that an intermediate ribbon lap is provided having a longitudinal extent and the lap fibers substantially arranged parallel to the delivery direction;

finally folding the intermediate ribbon lap intermittently in the direction of the longitudinal extent onto a final lap-carrying conveyor which extends and is caused to intermittently run transversely to the longitudinal extent of the intermediate ribbon lap such that a final lap is provided on the final lap-carrying conveyor having a width dimension greater than that of the card web and with the lap fibers arranged substantially in a longitudinal direction of the final lap; and cutting of the intermediate ribbon lap into final lap lengths so that on the final lap-carrying conveyor the final lap is discontinuous and formed from at least one layer of the final lap lengths arranged longitudinally and endwise.

7. A method for making final laps as claimed in claim 6 wherein said final folding step includes the step of overlapping the final lap lengths.

8. A method for making final laps as claimed in claim 6 wherein said intermediate folding step folds the card web onto an intermediate ribbon lap-carrying conveyor which extends and is caused to run transversely to the delivery direction.

9. A method for making final laps as claimed in claim 8 wherein said intermediate folding step continuously folds the card web onto the intermediate ribbon lap-carrying conveyor which is continuously run so that the intermediate ribbon lap is continuous with the ribbon lap fibers substantially arranged in a slightly inclined relation alternately to each side of the delivery direction.

10. A method for making final laps as claimed in claim 8 wherein said intermediate folding step intermittently folds the card web onto the intermediate ribbon lap-carrying conveyor which is intermittently run; and further including the step of cutting of the card web into ribbon lengths so that on the intermediate ribbon lap-carrying conveyor the intermediate ribbon lap is discontinuous and formed successively from at least one layer of the ribbon lengths arranged longitudinally and endwise.

11. A method for making final laps as claimed in claim 10 wherein said intermediate folding step includes the step of overlapping the ribbon lengths.

12. An apparatus for making final laps for needled felts comprising:

a delivery means for delivering a card web from a card with lap fibers substantially parallel to a delivery direction;

an intermediate ribbon lap-carrying conveyor which extends and is caused to intermittently run transversely to the delivery direction;

an intermediate folding means for intermediately folding the card web intermittently in the delivery into an intermediate ribbon lap and for delivering the ribbon lap onto said intermediate ribbon lap-carrying conveyor such that the intermediate ribbon lap has a longitudinal extent and the lap fibers are substantially arranged parallel to the delivery direction;

an intermediate cutting means for cutting of the card web into ribbon lengths so that on said intermediate ribbon lap-carrying conveyor the intermediate ribbon lap delivered by said intermediate folding means is discontinuous and formed successively from at least one layer of the ribbon lengths arranged longitudinally and endwise; and a final folding means for finally folding the intermediate ribbon lap in the direction of the longitudinal extent to form a final lap having a width dimension greater than that of the card web and the lap fibers substantially arranged in a longitudinal direction of the final lap.

13. An apparatus for making final laps as claimed in claim 12 wherein said intermediate folding means includes a means for overlapping the ribbon lengths.

14. An apparatus for making final laps as claimed in claim 12 and further including a final lap-carrying conveyor which extends and is caused to run transversely to the longitudinal extent of the intermediate ribbon lap such that said final folding means folds the intermediate ribbon lap onto said final lap-carrying conveyor.

15. An apparatus for making final laps as claimed in claim 14 wherein said final folding means intermittently folds the intermediate ribbon lap onto said final lap-carrying conveyor which is intermittently run; and further including a final cutting means for cutting of the intermediate ribbon lap into final lap lengths so that on said final lap-carrying conveyor the final lap is discontinuous and formed successively from at least one layer of the final lap lengths arranged longitudinally and endwise.

16. An apparatus for making final laps as claimed in claim 15 wherein said final folding means includes a means for overlapping the final lap lengths.

17. An apparatus for making final laps for needled felts comprising:

a delivery means for delivering a card web from a card with lap fibers substantially parallel to a delivery direction;

an intermediate folding means for intermediately folding the card web in the delivery direction such that an intermediate ribbon lap is provided having a longitudinal extent and the lap fibers substantially arranged parallel to the delivery direction;

a final lap-carrying conveyor which extends and is caused to intermittently run transversely to the longitudinal extent of the intermediate ribbon lap;

a final folding means for finally folding the intermediate ribbon lap intermittently in the direction of the longitudinal extent onto said final lap-carrying conveyor such that a final lap is provided on said final lap-carrying conveyor having a width dimension greater than that of the card web and with the lap fibers arranged substantially in a longitudinal direction of the final lap; and a final cutting means for cutting of the intermediate ribbon lap into final lap lengths so that on said final lap-carrying conveyor the final lap is discontinuous and formed from at least one layer of the final lap lengths arranged longitudinally and endwise.

18. An apparatus for making final laps as claimed in claim 17 wherein said final folding means includes a means for overlapping the final lap lengths.

19. An apparatus for making final laps as claimed in claim 17 and further including an intermediate ribbon lap-carrying conveyor which extends and is caused to run transversely to the delivery direction such that said intermediate folding means folds the card web onto said intermediate ribbon lap-carrying conveyor.

20. An apparatus for making final laps as claimed in claim 19 wherein said intermediate folding means continuously folds the card web onto said intermediate ribbon lap-carrying conveyor which is continuously run so that the intermediate ribbon lap is continuous with the ribbon lap fibers substantially arranged in a slightly inclined relation alternately to each side of the delivery direction.

21. An apparatus for making final laps as claimed in claim 19 wherein said intermediate folding means intermittently folds the card web onto said intermediate ribbon lap-carrying conveyor which is intermittently run; and further including an intermediate cutting means for cutting of the card web into ribbon lengths so that on said intermediate ribbon lap-carrying conveyor the intermediate ribbon lap is discontinuous and formed successively from at least one layer of the ribbon lengths arranged longitudinally and endwise.

22. An apparatus for making final laps as claimed in claim 21 wherein said intermediate folding means includes a means for overlapping the ribbon lengths.

* * * * *